US006634579B2

(12) United States Patent
Drenguis

(10) Patent No.: US 6,634,579 B2
(45) Date of Patent: Oct. 21, 2003

(54) METHOD OF AND APPARATUS FOR SHARPENING ORBITING KNIVES

(75) Inventor: Alfred Drenguis, Börnsen (DE)

(73) Assignee: Hauni Maschinenbau AG, Hamburg (DE)

( * ) Notice: Subject to any disclaimer, the term of this patent is extended or adjusted under 35 U.S.C. 154(b) by 337 days.

(21) Appl. No.: 09/847,597

(22) Filed: May 3, 2001

(65) Prior Publication Data

US 2002/0005098 A1 Jan. 17, 2002

(30) Foreign Application Priority Data

May 4, 2000 (DE) ..... 100 21 614

(51) Int. Cl.[7] ..... B02C 25/00

(52) U.S. Cl. ..... 241/30; 241/37; 241/101.2; 241/223; 241/242; 83/174; 451/72

(58) Field of Search ..... 241/101.2, 30, 241/37, 242, 33; 451/72; 83/13, 174

(56) References Cited

U.S. PATENT DOCUMENTS 4,467,970 A * 8/1984 Sagemuller ..... 241/101.2
4,627,577 A 12/1986 Hyuga et al.
4,635,402 A * 1/1987 Sakabe et al. ..... 451/193
4,640,059 A * 2/1987 Komossa et al. ..... 451/72
4,805,641 A 2/1989 Radzio et al.

FOREIGN PATENT DOCUMENTS

DE 29 21 665 C2 12/1980

* cited by examiner

*Primary Examiner*—Mark Rosenbaum
(74) *Attorney, Agent, or Firm*—Venable LLP; Robert Kinberg; Chad C. Anderson

(57) ABSTRACT

The orbiting knife or knives on a rotary knife holder in a tobacco shredding machine is or are automatically adjusted relative to a sharpening tool in response to signals indicating changes of one or more variable parameters which are indicative of the need for a sharpening of the knife or knives. Such parameters include at least the magnitude of torque which is required to rotate the knife holder but often also the temperature of the mass of condensed tobacco being fed into the range of the knife or knives, the quantity of tobacco per unit length of the mass, the mosture content of tobacco in the mass, the presence and/or the size and/or the nature of foreign matter in the mass, and others.

20 Claims, 3 Drawing Sheets

METHOD OF AND APPARATUS FOR SHARPENING ORBITING KNIVES

CROSS-REFERENCE TO RELATED CASES

This application claims the priority of the commonly owned copending German patent application Serial No. 100 21 614.5 filed May 4, 2000. The disclosure of such German patent application, as well as that of each US and/or foreign patent and patent application identified in the specification of the present application is incorporated herein by reference.

BACKGROUND OF THE INVENTION

The invention relates to improvements in methods of and in apparatus for sharpening one or more knives which is or are mounted on a rotary knife holder. More particularly, the invention relates to improvements in methods and apparatus which can be resorted to with advantage for automatic adjustment and sharpening of orbiting knives of the type employed in the tobacco processing industry to convert a continuous body (often called cake) of compacted fragments of tobacco leaves into a flow of shreds which are assembled into a so-called filler, namely into a continuous rod-shaped body which is ready to be draped into a continuous cigarette paper web or the like.

Certain presently known apparatus which are utilized to shred compacted fragments of tobacco leaves into shapes ready to be fed into a cigarette rod making machine (e.g., a machine known as PROTOS) are distributed by the assignee of the present application); such apparatus include those which are known all over the world as KT 2 cutters (also distributed by the assignee of the present application). The apparatus and the method of the present invention can be put to use by resorting to and in KT 2 cutters.

German patent No. 29 21 665 discloses a tobacco cutter (shredder) wherein a rotary holder carries at least one adjustable knife which orbits about a fixed axis and the cutting edge of which is sharpened by a grinding tool. The knife or knives are adjustable relative to the holder in order to compensate for wear attributable to repeated severing of a mass of compacted tobacco particles as well as to removal of knife material by the grinding implement.

The patented cutter employs a step-down transmission which serves to couple the drive for the knife holder with the knife adjusting system. The arrangement is such that the rate at which the knife or knives is or are shifted relative to the holder is determined by the step-down transmission. In order to change the speed of knife feed, one must manually adjust the operative connection between the step-down transmission and the knife or knives.

OBJECTS OF THE INVENTION

An object of the instant invention is to provide a novel and improved method of automatically compensating for wear upon one or more knives which are orbited by a rotary knife holder and undergo wear as a result of (a) repeated engagement with the commodity (such as the leader of a continuous cake or flow or mass of compacted fragments of tobacco leaves) and (b) repeated or continuous removal of knife material by one or more grinding and/or other knife sharpening implements.

Another object of the invention is to provide a method which can be practiced in connection with existing cutters, such as the aforementioned KT 2 cutter.

A further object of this invention is to provide a method which ensures that the rate of material removal from and the rate of adjustment of the knife or knives are selected in dependency upon all, or upon all important or relevant, parameters which influence the wear upon the knife or knives, e.g., in a tobacco shredding machine.

An additional object of the invention is to provide a novel and improved cutter or the type wherein a rotary holder carries one or more knives which orbit about the axis of the holder and undergo wear as a result of repeated contact with the material being severed (such as compacted tobacco leaves which must be shredded prior to admission into a cigarette making machine) and as a result of repeated sharpening by one or more grinding, honing and/or other material removing instrumentalities.

Still another object of the invention is to provide the above outlined cutter with novel and improved means for rendering the removal of material from and the feeding of the knife or knives dependent upon one or more important parameters which are disregarded in presently known cutters.

A further object of the invention is to provide a novel and improved automatic control system for the parts which influence the wear-dependent adjustments of the knife or knives in a tobacco shredding machine.

Another object of the invention is to provide a novel and improved method of evaluating and utilizing signals which are indicative of variable parameters of the material to be comminuted and/or of the comminuting machine.

An additional object of the invention is to provide a tobacco shredding machine wherein the knife or knives is or are sharpened only when a sharpening is necessary or advisable and only to the extent to restore the quality of the knife or knives to a desired or optimum value.

A further object of the present invention is to provide a novel and improved tobacco shredding apparatus which can carry out all of the above-enumerated novel functions and operations even though it can employ readily available standard monitoring, driving, motion transmitting and other components.

SUMMARY OF THE INVENTION

One feature of the present invention resides in the provision of a method of sharpening at least one knife which orbits along an endless path about a predetermined axis and the sharpening of which necessitates an adjustment relative to at least one sharpening tool (such as a grinding wheel) which is adjacent the path of orbital movement of the at least one knife. The improved method comprises the steps of monitoring the magnitude of torque which is required to orbit the at least one knife about the predetermined axis at a predetermined (desired or prescribed) speed, and adjusting the at least one knife relative to the at least one sharpening tool in response to departures of the magnitude of monitored torque from a predetermined range of acceptable magnitudes (this range can embrace a single acceptable magnitude or a plurality of such magnitudes).

The method can further comprise the steps of monitoring at least one of a plurality of additional parameters (i.e., parameters other than the aforediscussed torque) which influence the sharpness of the at least one knife, comparing the at least one additional parameter with a range of acceptable additional parameters, and adjusting the at least one knife relative to the at least one sharpening tool when the monitored at least one additional parameter is outside of the range of acceptable additional parameters. This method can be resorted to for automatically sharpening at least one knife which is utilized to repeatedly sever the leader of an advancing mass of compacted tobacco particles. The additional parameters can include the cross-sectional area of the leader of the advancing mass (i.e., the quantity of tobacco per unit length of the mass), the moisture content of the mass, the storage time of tobacco particles in the mass (this might exert some influence upon the moisture content of tobacco), the nature of treatment or treatments of tobacco particles prior to severing, the quantity of tobacco in the leader of the mass (this can depend upon the degree or extent of compacting of tobacco forming the mass), the homogeneousness (or lack of homogeneousness) of the mass, the percentage of comminuted tobacco leaves in the mass (as compared with the percentage of comminuted tobacco ribs, artificial tobacco or substitute tobacco), the brand or brands of tobacco in the mass, the temperature of the mass, the percentage and/or the size and/or the composition of foreign matter in the mass, the speed of advancement of the mass, and the extent of contaminatin of the at least one knife.

The monitoring step can include continuously monitoring the magnitude of torque which is required to orbit the at least one knife.

The method can further include the step of comparing the magnitude of monitored torque with the aforementioned range of acceptable magnitudes, and the adjusting step of such method can include moving the at least one knife relative to the at least one sharpening tool when the monitored torque is outside of such range. The just mentioned range can include a plurality of tolerable magnitudes of torque, and such method can further comprise the step of terminating the moving step when the monitoring step indicates that the magnitude of monitored torque is again within the required or desired range. In other words, monitoring of the magnitude of torque can be resorted to for initiation of the adjusting step as well as for termination of adjustment of the at least one knife.

As already mentioned hereinbefore, the improved method can further comprise the steps of monitoring a plurality of additional variable parameters (i.e., parameters other than torque) each of which influences the sharpness of the at least one knife to a different extent, and generating signals which denote the extent of influence of the additional parameters upon the sharpness of the at least one knife. Such method preferably further comprises the steps of processing the signals and utilizing the processed signals to adjust the at least one knife in dependency upon the influences of additional parameters upon the sharpness of the at least one knife. The processing can involve generating a single signal which is transmitted to the means for adjusting the at least one knife by taking into consideration all of the monitored parameters including the torque. The utilized step of the just discussed embodiment of the method can include adjusting the at least one knife only when the influence of additional parameters is unanticipated and exceeds a predetermined range of parameters. For example, if a first brand of tobacco is followed by a second brand the shredding of which necessitates the application of a greater force, an increase of the required torque is to be anticipated and need not necessarily result in an adjustment of the at least one knife.

The method preferably further comprises the step of at least intermittently dressing the at least one sharpening tool.

Another feature of the present invention resides in the provision of an apparatus for comminuting a mass of compacted smokable material. The apparatus comprises means for advancing the mass toward a severing or comminuting station, a knife holder which is rotatable at the comminuting station about a predetermined axis, at least one knife which is adjustably mounted on the holder for orbital movement about the axis along an endless path to repeatedly sever the leader of the mass at the comminuting station, at least one knife sharpening tool (e.g., a grinding wheel) adjacent the path of orbital movement of the at least one knife, adjustable means for displacing the at least one knife relative to the holder and relative to the at least one sharpening tool, means for applying to the holder a variable driving torque to rotate the at least one tool at a predetermined speed, means for monitoring the magnitude of the torque being actually applied to the holder to orbit the tool at the predetermined speed, and means for adjusting the at least one knife relative to the holder and the at least one sharpening tool when the magnitude of monitored torque departs from a range of acceptable magnitudes.

At least a portion of the knife displacing means is or can be borne by the holder.

The adjusting means can comprise means for comparing the monitored torque with the range of acceptable torques, i.e., the magnitude of monitored torque with the range of acceptable magnitudes.

The apparatus can further comprise at least one additional monitoring means which is arranged to generate signals denoting at least one variable parameter, namely a parameter other than the aforediscussed torque, which influences the sharpness of the at least one knife. The adjusting means of such apparatus includes means for adjusting the at least one knife when the at least one parameter is outside a range of acceptable parameters. For example, the at least one parameter can be indicative of at least one of (a) the cross-sectional area of the mass at the severing or comminuting station, (b) the moisture content of the mass, (c) the composition of the mass, (d) the nature (such as brand) of smokable material, and (e) the temperature of the mass.

The monitoring means can include means for generating first signals which denote the monitored magnitude of torque, and the apparatus can further comprise at least one additional monitoring means which is arranged to generate second signals denoting at least one variable parameter (e.g., the moisture content or the quantity of tobacco per unit length of the mass, i.e., a parameter other than torque) which influences the sharpness of the at least one knife, and the adjusting means of such apparatus can include means for processing the first and second signals into additional signals and for initiating adjustment of the at least one knife relative to the holder and relative to the at least one sharpening tool when the additional signals are outside of a predetermined range of signals.

As already mentioned above, the torque monitoring means can include means for generating signals which denote the monitored magnitude of torque; the adjusting means of such apparatus can include means for storing a range of signals denoting acceptable magnitudes of torque, means for comparing signals which denote the magnitude of monitored signals with the range of stored signals, and means for initiating adjustment of the at least one knife relative to the holder and the at least one sharpening tool when a signal which denotes the magnitude of monitored torque is outside of the range.

The advancing means can include conveyors (such as chain conveyors) which are arranged to advance smokable material along a predetermined path ending at the severing station, and means for condensing smokable material in the mass by way of at least one of the conveyors.

The adjusting means can comprise a computer (such as a microprocessor), and the monitoring means can include a sensor which is arranged to transmit signals to the computer.

The torque applying means can comprise a variable-speed electric motor or another suitable prime mover, and the monitoring means can include a suitable torque sensor which is arranged to monitor the torque being transmitted by the prime mover to the knife holder.

The novel features which are considered as characteristic of the invention are set forth in particular in the appended claims. The improved cutting or comminuting apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
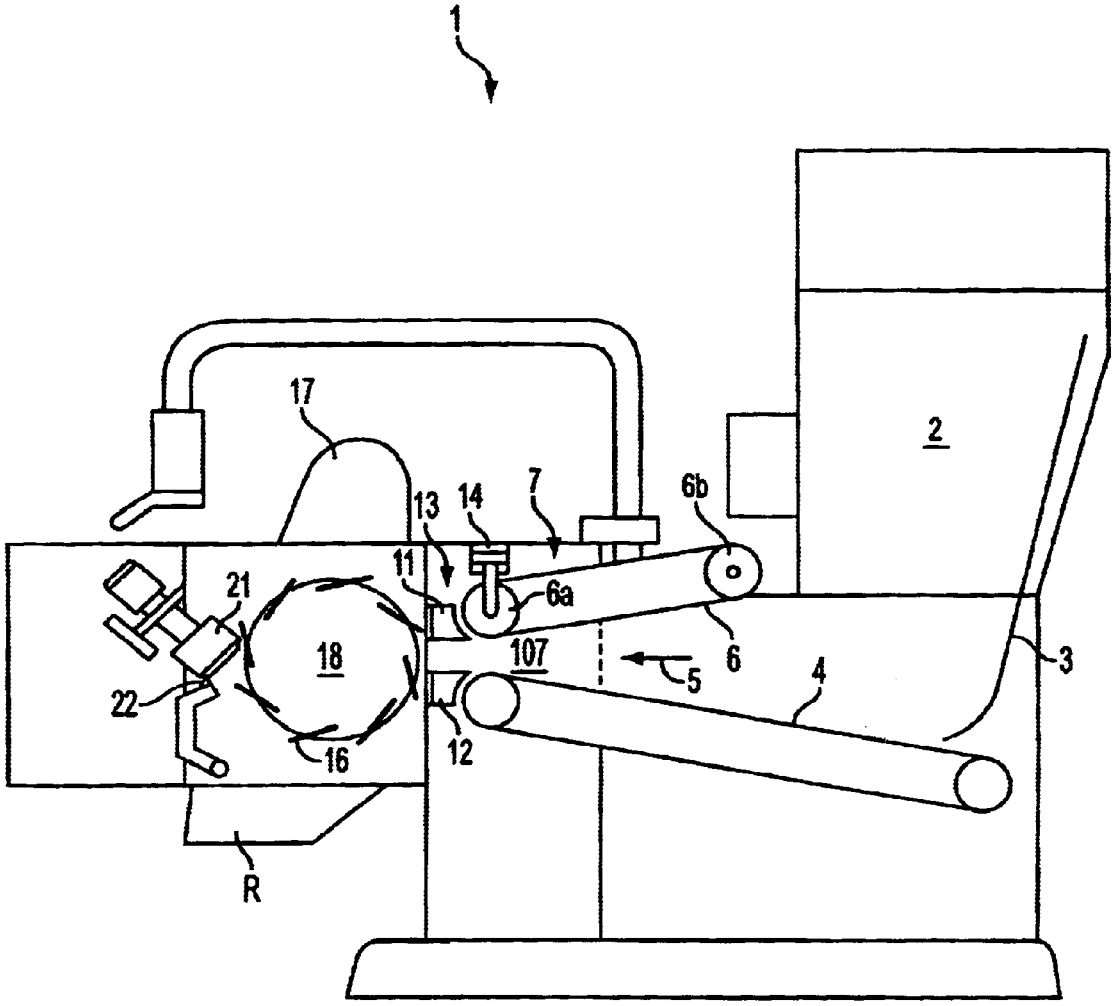
FIG. 1 is a schematic elevational view of a tobacco shredding apparatus wherein the sharpening of knives can be regulated in accordance with one presently preferred embodiment of the invention.

FIG. 1 illustrates certain details of a tobacco cutting (shredding) machine 1 wherein an upright duct 2 receives a flow (e.g., a shower) of pretreated (such as moistened, flavored and/or otherwise conditioned) tobacco particles, such as a mixture of fragments of tobacco leaves and fragments of tobacco ribs, from a suitable source, not shown. An oscillatable rake 3 is provided to repeatedly feed the lower end portion of a continuously gathering column of tobacco particles from the lower end portion of the duct 2 into the rear end portion of a substantially horizontal path defined by two forwardly converging endless chains 4, 6 of a tobacco compressing or condensing or caking and advancing unit 7 in the machine 1. The chains 4, 6 convert the particles being repeatedly fed by the rake 3 into a cake or flow or mass (hereinafter called mass) which advances in the direction of the arrow 5 toward and through an adjustable mouthpiece 13 including a fixed lower section 12 and an adjustable upper section 11.

The means for driving the chains 4 and 6 so that their confronting stretches or reaches advance the continuously developing tobacco mass toward and into the mouthpiece 13 can comprise an electric motor or any other suitable prime mover, not shown. The front sprocket wheel 6*a* for the upper endless chain 6 is attached to the lower end portion of a pressure generator 14 which causes the front end portion of the lower reach of this chain to bear upon the advancing tobacco mass with a variable force. The pressure generator 14 can employ a variable-capacity plenum chamber or a fluid-operated cylinder and piston unit wherein the pressure of confined hydraulic or pneumatic fluid is variable within a desired range. The chain 6 is pivotable about the axis of the rear sprocket wheel 6*b*.

The lower section 12 of the mouthpiece 13 constitutes a counterknife which cooperates with successive orbiting knives 16 on a rotary drum-shaped knife holder 18 to repeatedly sever the leader of the advancing tobacco mass. The thus obtained shreds descend into a receptacle R to be transported away to the cigarette making machine (e.g., a machine shown and described in commonly owned U.S. Pat. No. 4,805,641 granted Feb. 21, 1989 to Radzio et al. for "METHOD AND APPARATUS FOR ASCERTAINING THE DENSITY OF WRAPPED TOBACCO FILLERS AND THE LIKE").

The knife holder 18 is driven by a prime mover 17, e.g., a variable-speed electric motor. The knives 16 extend beyond the periphery of the holder 18 at an acute angle to the tangent at the point where a knife extends from the holder. The means for sharpening the cutting edges of successive knives 16 comprises a grinding wheel 21 which is rotatable about an axis extending substantially tangentially of the knife holder 18, and the means for dressing the grinding wheel 21 comprises a diamond 22.

Figure 2:
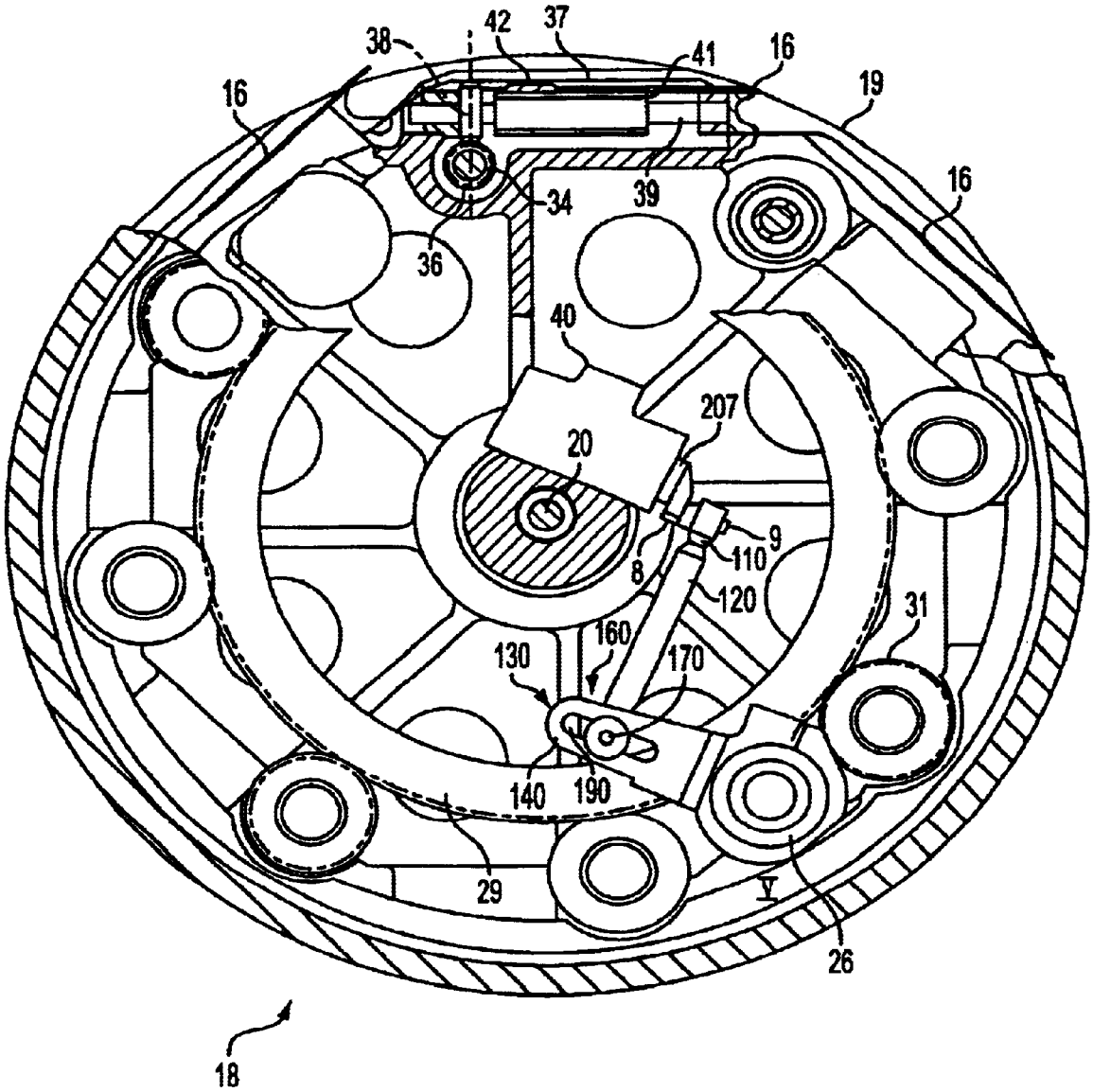
FIG. 2 is a greatly enlarged transverse sectional view of the rotary holder for the knives in the apparatus of FIG. 1.

FIG. 2 illustrates certain details of the arrangement of parts in the interior of the knife holder 18. The hollow cylindrical housing 19 of this holder mounts several knives 16 which are preferably equidistant from each other (as seen in the circumferential direction of the housing 19). The reference character 20 denotes the drive shaft for the rotor 18; this shaft receives torque from the prime mover 17.

A servomotor 40 in the housing 19 serves to initiate movements of the knives 16 relative to the holder 18; this servomotor is operatively connected with a regulating unit 109 (see FIG. 3) by slip rings, not shown, and adjusts the knives 16 while the shredding machine 1 is in use. The operative connection between the servomotor 40 and the knives 16 comprises, among others, a shaft 207 which receives torque from, and extends beyond the housing of, the servomotor. The free end portion of the shaft 107 carries a crank drive 8, and the crank pin 9 of this crank drive carries an articulated joint 110 for one end portion of a push rod 120 which connects the crank drive with a further drive 130, including a pivotable lever 140, by means of an adjusting device 160. The latter comprises a pin 170 which is articulately connected with the other end portion of the push rod 120 by way of another articulated joint, not shown. An end portion of the pin 170 is movable in an elongated slot 190 of the lever 140.

The pivotable lever 140 carries a freewheel 26 which is adjacent the axis of the lever; the freewheel 26 includes a shaft for a spur gear (not shown) which mates with and drives an internal gear 29. This internal gear further mates with spur gears 31, one for each of the knives 16, and is coaxial with the knife holder 18. Each spur gear 31 is mounted on a discrete shaft 34, and each such discrete shaft carries a worm 36 serving to transmit motion to the displacing or moving means 37 for the respective knife 16 by way of a worm wheel 38.

FIG. 2 merely shows a single displacing means 37 which is located at one axial end of the shaft 34, i.e., at one end face of the housing 19. An extension of the shaft 34 (this extension projects at right angles to the plane of FIG. 2) carries a second displacing means which can constitute a mirror image of the displacing means 37 shown in FIG. 2 and is adjacent the other end face of the housing 19. In other words, the cutting edges of the knives 16 extend in parallelism with the shaft 20 outwardly adjacent the periphery of the housing 19, and each of the two end portions of each knife 16 is movable by discrete displacing means 37. Such arrangement ensures that the orientation of the knives 16 relative to the holder 18 remains unchanged during each shifting relative to the housing 19 and grinding wheel 21.

FIG. 2 shows that the illustrated worm wheel 38 is mounted on a feed screw assembly 39 having an externally threaded shaft 41 in mesh with an internally threaded follower or half nut 42 which carries the respective knife 16. The exact construction of the means for adjusting and moving the knives 16 relative to their rotary cylindrical holder 18 is or can be identical with or analogous to that described in the aforementioned German patent No. 29 21 665 the disclosure of which (as already mentioned hereinbefore) is incorporated herein by reference.

Figure 3:
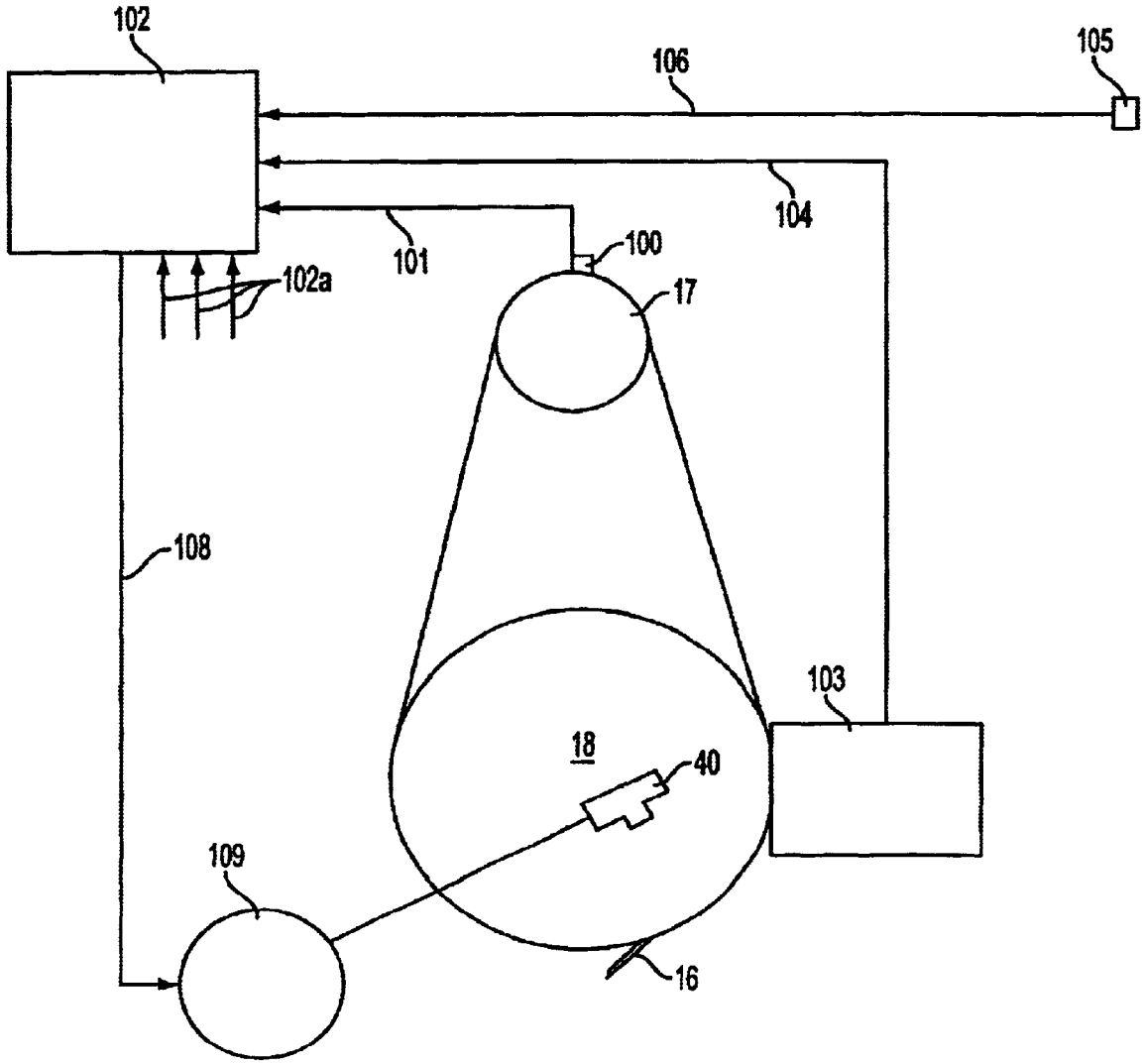
FIG. 3 is a diagrammatic view of the controls for the knife adjusting means in the apparatus of FIGS. 1 and 2.

The presently preferred modes of operation of a tobacco shredding machine 1 embodying the structure shown in FIGS. 1 and 2, and particularly the method of and the means for grinding or sharpening the cutting edges of the knives 16, will be described with reference to FIG. 3. The operating means comprises a control unit including a microprocessor 102 having several inputs and an output for transmission of signals via conductor 108 to the regulating unit 109 for the servomotor 40. One input of the microprocessor 102 is connected, by a conductor 101, to a torque sensor 100 which monitors the torque being transmitted by the prime mover 17 to the knife holder 18. A second sensor 103 monitors the height of the mouthpiece 13 and transmits corresponding signals to a second input of the microprocessor 102 via conductor means 104. A further conductor 106 connects a third input of the microprocessor 102 with the output of a sensor 105 which monitors the moisture content of tobacco in the mass advancing toward, through and beyond the mouthpiece 13, i.e., into the range of the orbiting knives 16. The sensor 105 can be installed in or at a sidewall 107 (see FIG. 1) of that portion of the housing or casing of the apparatus 1 which flanks the path of the mass of tobacco particles advancing into and/or through the mouthpiece 13, preferably at a level below the lower reach of the chain 6 but above the upper reach of the chain 4. The sensor 105 can be of the type known as PROMOS which is distributed by the assignee of the present application.

The exact construction of the sensors 100, 103 and 105 forms no part of the present invention. Each of the sensors 103, 100 can constitute a commercially available monitoring device, the same as the aforementioned PROMOS (sensor 105). Furthermore, the improved apparatus can employ one or more or many more additional sensors for measurements of variations of parameters other than torque, the cross-sectional area of the mass issuing from the mouthpiece 13 and the moisture content of such mass. Several inputs forming part of the microprocessor 102 and connected to conductors for transmission of signals from the aforementioned additional sensors are shown in FIG. 3, as at 102*a*.

The microprocessor 102 compares the characteristics of signals transmitted thereto by the torque sensor 100 via conductor 101 with a reference value stored in a memory (not shown) of the microprocessor. If the intensity and/or another characteristic of the signal from the torque sensor 100 is within a predetermined range of acceptable signals, the output of the microprocessor 102 transmits no signals to the regulating unit 109 for the servomotor 40, i.e., the positions of the knives 16 relative to their holder 18 remain unchanged.

If one or more characteristics of the signal being transmitted by the torque sensor 100 are outside of the prescribed range but the signal from the moisture sensor 105 indicates that the moisture content of tobacco particles in the lengthwise advancing mass being severed at the discharge end of the mouthpiece 13 is relatively high, and/or that the height of the mouthpiece 13 exceeds a given value, the output of the microprocessor 102 also fails to send a signal via conductor 108 to adjust the positions of the knives 16 relative to the knife holder 18 by way of the operating unit 109, servomotor 40 and the aforedescribed operative connections between the servomotor and the displacing means 37 for the knives 16.

However, if the intensity or another characteristic of the signal from the torque sensor 100 to the microprocessor 102 is outside of the aforementioned stored or memorized range of acceptable signals, even if one takes into consideration the variable parameters monitored by the sensors 103 and 105 (this normally involves a rise of the measurable parameter of the signal being transmitted by the torque sensor 100 above a maximum permissible or acceptable value), the microprocessor 102 transmits a signal to the regulating unit 109 via conductor means 108. This initiates an adjustment of the knives 16 relative to the rotary holder 18 and the grinding wheel 21. Thus, such adjustment of the knives 16 results in a grinding (sharpening) of their cutting edges by the wheel 21.

It is also possible to (continuously or stepwise) calculate new acceptable torques on the basis of intermittently or continuously transmitted signals from the sensors 103, 105, and to compare the thus calculated signals with those being transmitted by the sensor 100. The regulating unit 109 receives a signal (via conductor 108) to adjust the knives 16 if the signal which is furnished by the torque sensor 100 departs sufficiently from the freshly calculated signals being furnished by the microprocessor 102.

The following examples of several modes of operation of the improved shredding apparatus are based on the premises enumerated below:

(a) The quality of tobacco being supplied to the chains 4, 6 by the duct 2 and oscillatable rake 3 is at least substantially constant.

(b) The apparatus 1 is operated at a normal speed, i.e., the starting stage is already completed.

(c) The cutting edges of the knives 16 are sharp (i.e., the knives are new or the knives have already undergone one or more sharpening or grinding treatments).

(d) Except for the cutting force (i.e., the ascertained torque of the prime mover 17 for the rotary knife holder 18 of the apparatus 1), all other parameters remain constant.

(e) The knives 16 are moved and sharpened when required.

EXAMPLE 1

This example involves a sharpening of knife edges in dependency upon the difference between the desired sharpness and the actual sharpness. Due to (i.e., as a result of) wear upon the knives 16, the magnitude of the required cutting force, as averaged by a computer during an interval of 15 minutes, rises continuously from a lower threshold value (stored in and made available for readout by a first memory) to a second or upper threshold value stored in and made available for readout by a second memory. The rise of the required cutting force to the higher second threshold value is ascertained by a sensor which monitors the cutting force, and this initiates an adjustment of the knives 16 relative to the holder 18 and a corresponding sharpening of cutting edges of the knives by the grinding wheel 21.

EXAMPLE 2

It is assumed that the tobacco mass being fed into the mouthpiece 13 contains small foreign particles. The circumstances outlined in the Example 1 are departed from (interrupted or disturbed) for an interval of about two seconds by first increasing and by thereupon reducing the cutting force. The foreign particles are of such nature that they cause a partial destruction of the cutting edges of the knives 16 so that, after the foreign particles have advanced beyond the shredding or comminuting station (where successive knives 16 cooperate with the lower section (counterknife) 12 of the mouthpiece 13), the cutting edges are out of contact with the grinding wheel 21.

EXAMPLE 3

The mass of compacted tobacco advancing into the mouthpiece 13 contains large foreign particles. This causes an abrupt departure from the desired shredding operation (as outlined in the Example 1). When the upper threshold value referred to in the Example 1 is exceeded, the apparatus 1 is brought to a halt and a device generates a (visible and/or audible and/or other) signal indicating that the tobacco mass contains large foreign particles (particularly particles which are likely or bound to cause serious damage to or a destruction of the knives).

EXAMPLE 4

The moisture content of tobacco entering the mouthpiece 13 decreases. This entails a need for a greater cutting force, namely for a rise of cutting force proportional to a reduction of the moisture content. The drop of moisture content is signaled by a sensor, such as the sensor 105. Also, the torque sensor 100 transmits signals denoting the increased cutting force which is required by the rotating knife holder 18 to rotate at a particular speed, and the microprocessor 102 causes the regulating unit 109 to effect an appropriate movement of the knives 16 relative to the holder 18, i.e., relative to the grinding wheel 21. The adjustment of the knives 16 is terminated when the sensor 100 indicates that the magnitude of required torque is back to the previous value. If the cutting force monitored by the sensor 100 cannot be stabilized (returned to normal or expected) by the expedient of moving the knives 16 relative to the holder 18 and grinding wheel 21, the apparatus 1 is brought to a halt, e.g., when the actually detected required cutting force (torque) exceeds the prescribed or expected cutting force by a predetermined value.

The present invention is based on the discovery that the ascertainment of torque which is required to rotate the knife holder 18, i.e., to orbit the knives 16 past the counterknife 12, is an important factor which renders it possible to make accurate and valuable conclusions regarding the sharpness of the cutting edges of the knives (i.e., of the need to sharpen the knives). The reason is that, if all other operational parameters remain unchanged, a reduction of sharpness of the cutting edge(s) of the knife or knives will necessarily and reliably entail the need for the transmission of greater torque from the prime mover 17 to the rotary knife holder 18, i.e., a greater force will be required to cause dull or duller knives to remove shreds from the leader of the mass of compressed particles issuing from the mouthpiece 13. Consequently, a monitoring of the magnitude of torque being transmitted from the prime mover 17 to the rotary knife holder 18 furnishes information which can be evaluated to effect an optimum advancement of knives 16 relative to the knife holder 18, i.e., to ensure that the extent of sharpening of knife edges by the grinding wheel 21, and/or any other equivalent or suitable sharpening tool, will be exactly or adequately commensurate with the departure of actual sharpness of the knife edges from the required or optimum sharpness. The grinding wheel 21 can resemble or constitute a so-called cup wheel or face wheel.

As already mentioned hereinbefore, the actually required torque for rotation of the knife holder 18 (i.e., for orbiting the knives 16 at the required speed) is not the only parameter which warrants or merits consideration in connection with grinding or sharpening of the knives. Thus, it is possible to select the extent of knife sharpening as a function of variations of the required torque plus one or more parameters; this renders it possible to even more accurately select the required intensity or extent of the sharpening action. In addition, monitoring of one or more variable parameters in addition to the magnitude of torque which is required to drive the knife holder 18 renders it possible to uncover or detect or ascertain other causes of the need for increased torque. For example, it is possible to ascertain whether the increased torque is needed in view of the dullness of the knife edges (i.e., of the extent of departure of knife edge sharpness from optimum sharpness) and/or due to an increased cross-sectional area of the leader of the tobacco mass, i.e., due to increasing height of the mouthpiece 13 (this is monitored by the sensor 103). The magnitude of required torque increases with increasing height of the tobacco mass between the mouthpiece sections 11, 12 if the force being applied by the pressure generator 14 to the front sheave 6*a* for the chain 6 is at least substantially constant.

Other important parameters which influence the rate of wear upon the cutting edges of the knives 16 include the moisture content of tobacco in the channel between the chains 4 and 6 (note again the sensor 105), the nature of treatment of tobacco particles prior to admission into the duct 2, the sizes of the particles being fed into the duct (i.e., the percentage of larger or smaller tobacco particles in the mass advancing into the mouthpiece 13), the homogeneousness of tobacco in such mass, the percentage and/or the nature and/or the size of foreign particles (these can include pieces of rock and/or dust) in the mass flow, and the temperature of tobacco entering the mouthpiece 13.

For example, if the moisture content of tobacco entering the mouthpiece 13 is relatively high, the severing (shredding) of such tobacco will necessitate the application of increased torque to the knife holder 18. However, if the need for increased torque is ascertained (at 100 and 102) when the sensor 105 indicates the need for an increased torque while all other parameters remain unchanged, there is no need to move the knives 16 relative to the holder 18 and grinding wheel 21 because the need for increased torque is attributable to higher moisture content of tobacco particles in the channel between the chains 4 and 6.

An increased percentage of tobacco leaf laminae in the compacted mass can be readily ascertained and monitored in any known manner to be compared with a desired or acceptable or permissible percentage of tobacco leaf laminae. Under such circumstances, the procedure is the same as in the event of a higher moisture content, i.e., it is not necessary to sharpen the knife edges because the need for increased torque is legitimate, namely it is attributable to a higher percentage of laminae (i.e., to the admission of a different blend of tobacco) rather than to excessive dullness of the knives 16.

The situation is the same or similar if a first type of tobacco is replaced by a second type and/or if the first type is mixed with substantial quantities of a second type. Thus, shredding of tobacco of the second type can necessitate the application of a greater cutting force, i.e., an at least partial substitution of a readily shreddable first tobacco type with a tougher second tobacco type will or can cause the sensor 100 to indicate the need for a greater torque but this need not necessitate any adjustments of the knives 16 relative to the holder 18 because the need for greater torque is legitimate, i.e, it is attributable to the presence of less readily shreddable tobacco.

In accordance with an additional feature of the present invention, one monitors the cutting speed and/or the extent of contamination of the knife or knives 16 on the rotary holder 18. This can be readily accomplished by resorting to laser-operated sensors. The signals furnished by such sensors can also serve to initiate the shifting of the knife or knives 16 relative to the holder 18 and the grinding wheel 21 (or any other selected knife sharpening device or devices). Such adjustments can be resorted to in addition to or in lieu of one or more previously discussed adjustments (e.g., in addition to or instead of temperature-, mouthpiece height- and/or homogeneousness-dependent adjustments).

It is further within the purview of the present invention to process the signals being transmitted from two, three or more sensors and to thus arrive at a signal which is utilized for the initiation of adjustment of the knife or knives 16 relative to the holder 18 and the grinding wheel 21. The various parameters which are utilized for comparison with the actually determined parameters can be preselected and the thus obtained information stored in the memory or memories of the corresponding unit of the improved apparatus (e.g., in the memory or memories of the microprocessor 102), or such various parameters can be altered from time to time. As far as various sensors (such as those shown at 100, 103 and 105) are concerned, they can be set up to transmit signals continuously or at preselected fixed or variable intervals. The microprocessor 102, too, can be set up to process the received signals continuously or at intervals and to transmit to the regulating unit 109 signals which initiate an adjustment of the knife or knives 16 when necessary in view of the change of characteristics of a single incoming signal (e.g., via conductor means 101, 104 or 106) or when the processing of two or more incoming signals indicates that an adjustment of the knife or knives (i.e., a sharpening of the cutting edge or edges) is advisable or necessary. As already mentioned hereinabove, it is advisable (at least in connection with one specific monitoring operation or with certain specific monitoring operations) to design the microprocessor 102 (or an equivalent thereof) in such a way that the signals being transmitted thereto (e.g., by the sensor 103 and/or 105) are compared with a range of acceptable signals and that an adjustment of the knife or knives 16 is initiated (for the purpose of sharpening the cutting edge or edges) only when the intensity and/or other characteristics of the incoming signal(s) depart from those of the memorized range of acceptable signals. In other words, it is often desirable to select for each incoming signal a range of tolerances which must be exceeded before the incoming signal or signals is or are utilized to initiate a sharpening of the severing tool or tools.

The number and/or the composition and/or the configuration of the shredding implements can be selected in dependency upon the nature of the material most likely to be shredded in the improved apparatus. This also applies for the means which are utilized to convert a shower of particles into a mass which is caused to enter into and to advance through the mouthpiece 13, i.e., into the range of the orbiting knife or knives 16.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of shredding tobacco or the like and, therefore, such adaptations should and are intended to be comprehended within the meaning and range of equivalence of the appended claims.

What is claimed is:

1. A method of sharpening at least one knife which orbits along an endless path about a predetermined axis and the sharpening of which necessitates an adjustment relative to at least one sharpening tool adjacent said path, comprising the steps of:

monitoring the magnitude of torque which is required to orbit the at least one knife about said axis at a predetermined speed; and adjusting the at least one knife relative to the at least one sharpening tool in response to departures of the magnitude of monitored torque from a predetermined range of acceptable magnitudes.

2. The method of claim 1, further comprising the steps of monitoring at least one of a plurality of additional parameters which influence the sharpness of the at least one knife, comparing the at least one additional parameter with a range of acceptable additional parameters, and adjusting the at least one knife relative to the at least one sharpening tool when the monitored at least one additional parameter is outside of said range of acceptable additional parameters.

3. The method of claim 2 of automatically sharpening at least one knife which is utilized to repeatedly sever the leader of an advancing mass of compacted tobacco particles, wherein said additional parameters include the cross-sectional area of the leader of the advancing mass, the moisture content of the mass, the storage time of tobacco particles in the mass, the nature of treatment of tobacco particles prior to severing, the quantity of tobacco in the leader of the mass, the homogeneousness of the mass, the percentage of comminuted tobacco leaves in the mass, the brand of tobacco in the mass, the temperature of the mass, the percentage of foreign matter in the mass, the speed of advancement of the mass, and the extent of contamination of the at least one knife.

4. The method of claim 1, wherein said monitoring step includes continuously monitoring the magnitude of torque which is required to orbit the at least one knife.

5. The method of claim 1, further comprising the step of comparing the monitored torque with said range of acceptable torques, said adjusting step including moving the at least one knife relative to the at least one sharpening tool when the monitored torque is outside of said range.

6. The method of claim 5, wherein said range includes a plurality of tolerable magnitudes of torque.

7. The method of claim 5, further comprising the step of terminating said moving step when the manitoring step indicates that the magnitude of monitored torque is again within said range.

8. The method of claim 1, further comprising the steps of monitoring a plurality of additional variable parameters each of which influences the sharpness of the at least one knife to a different extent and generating signals denoting the extent of influence of said additional parameters upon the sharpness of the at least one knife, processing said signals and utilizing the processed signals to adjust the at least one knife in dependency upon the influences of additional parameters upon the sharpness of the at least one knife.

9. The method of claim 8, wherein said utilizing step includes adjusting the at least one knife only when the influence of additional parameters is unanticipated and exceeds a predetermined range of tolerances.

10. The method of claim 1, further comprising the step of at least intermittenty dressing the at least one sharpening tool.

11. Apparatus for comminuting a mass of compacted smokable material, comprising:

means for advancing the mass toward a severing station;

a knife holder rotatable at said station about a predetermined axis;

at least one knife adjustably mounted on said holder for orbital movement about said axis along an endless path to repeatedly sever the mass at said station;

at least one knife sharpening tool adjacent said path;

adjustable means for displacing said at least one knife relative to said holder and said at least one sharpening tool;

means for applying to said holder a variable driving torque;

means for monitoring the magnitude of the torque being applied to said holder; and means for adjusting said at least one knife relative to said holder and said at least one sharpening tool when the magnitude of monitored torque departs from a range of acceptable magnitudes.

12. The apparatus of claim 11, wherein at least a portion of said displacing means is borne by said holder.

13. The apparatus of claim 11, wherein said adjusting means includes means for comparing the monitored torque with said range of acceptable torques.

14. The apparatus of claim 11, further comprising at least one additional monitoring means arranged to generate signals denoting at least one variable parameter, other than said torque, which influences the sharpness of the at least one knife, said adjusting means including means for adjusting said at least one knife when the at least one parameter is outside of a range of acceptable parameters.

15. The apparatus of claim 14, wherein said at least one parameter is indicative of at least one of (a) the cross-sectional area of the mass at said severing station, (b) the moisture content of the mass, (c) the composition of the mass, (d) the nature of smokable material, and (e) the temperature of the mass.

16. The apparatus of claim 11, wherein said monitoring means includes means for generating first signals denoting the monitored magnitude of torque and further comprising at least one additional monitoring means arranged to generate second signals denoting at least one variable parameter, other than said torque, which influences the sharpness of the at least one knife, said adjusting means including means for processing said first and second signals into additional signals and for initiating adjustment of said at least one knife relative to said holder and said at least one sharpening tool when said additional signals are outside of a predetermined range of signals.

17. The apparatus of claim 11, wherein said monitoring means includes means for generating signals denoting the monitored magnitude of torque, said adjusting means including means for storing a range of signals denoting acceptable magnitudes of torque, means for comparing signals denoting the magnitude of monitored torque with said range of signals, and means for initiating adjustment of said at least one knife relative to said holder and said at least one sharpening tool when a signal which denotes the magnitude of the monitored torque is outside of said range.

18. The apparatus of claim 11, wherein said advancing means includes conveyors arranged to move smokable material along a predetermined path ending at said severing station, and means for condensing smokable material in said mass by way of at least one of said conveyors.

19. The apparatus of claim 11, wherein said adjusting means comprises a computer and said monitoring means comprises a sensor arranged to transmit signals to said computer.

20. The apparatus of claim 11, wherein said torque applying means includes a prime mover and said monitoring means includes a sensor arranged to monitor the magnitude of torque being transmitted by said prime mover to said holder.

* * * * *